US007445432B2

(12) United States Patent
Levine et al.

(10) Patent No.: US 7,445,432 B2
(45) Date of Patent: Nov. 4, 2008

(54) ENHANCED SERPENTINE COOLING WITH U-SHAPED DIVIDER RIB

(75) Inventors: Jeffrey R. Levine, Vernon, CT (US); William Abdel-Messeh, Middletown, CT (US); Raymond Surace, Newington, CT (US); Eleanor Kaufman, Cromwell, CT (US)

(73) Assignee: United Technologies Corporation, Hartford, CT (US)

( * ) Notice: Subject to any disclaimer, the term of this patent is extended or adjusted under 35 U.S.C. 154(b) by 243 days.

(21) Appl. No.: 11/391,781

(22) Filed: Mar. 28, 2006

(65) Prior Publication Data

US 2007/0231138 A1 Oct. 4, 2007

(51) Int. Cl.
*F01D 5/18* (2006.01)

(52) U.S. Cl. ..... 416/96 R; 415/115; 415/116; 416/96 A; 416/97 R

(58) Field of Classification Search ..... 415/115, 415/116; 416/96 R, 96 A, 97 R
See application file for complete search history.

(56) References Cited

U.S. PATENT DOCUMENTS

| | | | | |
|---|---|---|---|---|
| 4,753,575 | A * | 6/1988 | Levengood et al. | 416/97 R |
| 2003/0108422 | A1 * | 6/2003 | Merry | 416/97 R |
| 2006/0153679 | A1 * | 7/2006 | Liang | 416/97 R |

* cited by examiner

*Primary Examiner*—Igor Kershteyn
(74) *Attorney, Agent, or Firm*—Bachman & LaPointe, P.C.

(57) ABSTRACT

A cooling passageway for use in an airfoil prtrion of a turbine engine component having a pressure side wall and a suction side wall is provided. The cooling passsageway comprises a serpentine flow passageway through which a cooling fluid flows. The passageway has an inlet through which cooling fluid is introduced into the passageway, an inlet channel for receiving the cooling fluid, an intermediate channel, and an outlet channel. A divider rib extends from a location in the inlet channel to a termination in the intermediate channel to improve the heat transfer coefficients associated with the passageway.

19 Claims, 4 Drawing Sheets

ENHANCED SERPENTINE COOLING WITH U-SHAPED DIVIDER RIB

BACKGROUND OF THE INVENTION (1) Field of the Invention

The present invention relates to enhanced convective cooling resulting from adding a U-shaped divider rib dividing a plurality of cooling fluid channels in a serpentine cooling passage.

(2) Prior Art

Vanes currently used in gas turbine engines use a three pass serpentine cooling passageway 10 such as that shown in FIGS. 1 and 2 to convectively cool a mid-body region of the airfoil 11. Cooling fluid enters the passageway 10 through a fluid inlet 12 and travels through the inlet channel 14, then around a first turn 16 into an intermediate channel 18, then around a second turn 20, and through an outlet channel 22. Heat transfer tests have shown that this configuration can be inadequate and cooling losses may be encountered due to poorly developed flow structure in the channels 14 and 18 and large regions of flow separation downstream of the first turn 16, extending almost to the second turn 20. These issues can be attributed to both the low flow rate per unit flow area, and to the very low aspect ratio in the channel 18 with long rough walls and short divider walls.

There is a need for a cooling passageway for the airfoil portion that has an improved flow structure and better heat transfer properties.

SUMMARY OF THE INVENTION

In accordance with the present invention, a cooling passageway is provided which has an improved flow structure and improved heat transfer properties.

In accordance with the present invention, a cooling passageway for use in an airfoil portion of a turbine engine component having a pressure side wall and a suction side wall is provided. The cooling passageway broadly comprises a serpentine flow passageway through which a cooling fluid flows, which passageway has an inlet through which cooling fluid is introduced into the passageway, an inlet channel, an intermediate channel, and an outlet channel, and a divider rib extending from a location in the inlet channel to a termination in the intermediate channel.

Further in accordance with the present invention, a turbine engine component is provided. The turbine engine component broadly comprises an airfoil portion having a suction side wall and a pressure side wall, and a serpentine cooling passageway within the airfoil portion located between the suction side wall and the pressure side wall. The serpentine cooling passageway has an inlet channel, an intermediate channel, a first turn fluidly connecting the inlet channel to the intermediate channel, an outlet channel, and a second turn fluidly connecting the intermediate channel to the outlet channel. The inlet channel communicates with a source of cooling fluid via a fluid inlet. The cooling passageway further has means for dividing the flow within the inlet channel and a portion of the intermediate channel into two flow streams for providing improved heat transfer coefficients.

Other details of the enhanced serpentine cooling with U-shaped divider rib of the present invention, as well as other objects and advantages attendant thereto, are set forth in the following detailed description and the accompanying drawings, wherein like reference numerals depict like elements.

DETAILED DESCRIPTION OF THE PREFERRED EMBODIMENT(S)

Figure 1:
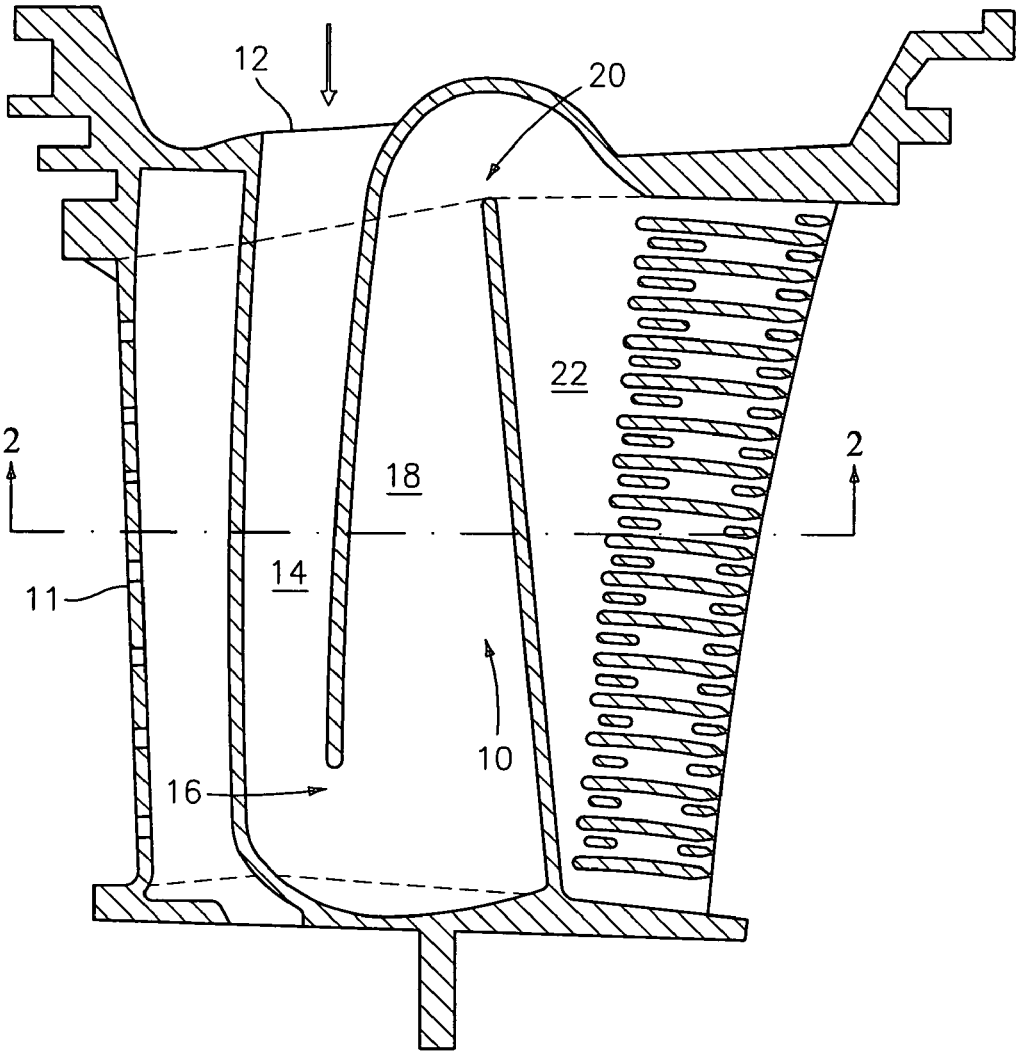
FIG. 1 (PRIOR ART)
FIG. 1 is a sectional view of a prior art airfoil portion of a turbine engine component having a serpentine cooling passageway.
Figure 2:
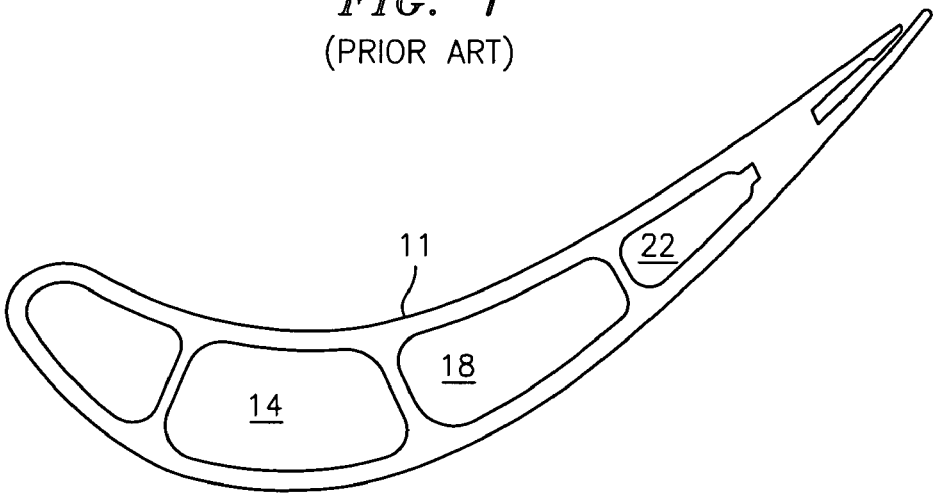
FIG. 2 (PRIOR ART)
FIG. 2 is a sectional view of the prior art airfoil portion with the serpentine cooling passageway taken along lines 2-2 in FIG. 1.
Figure 3:
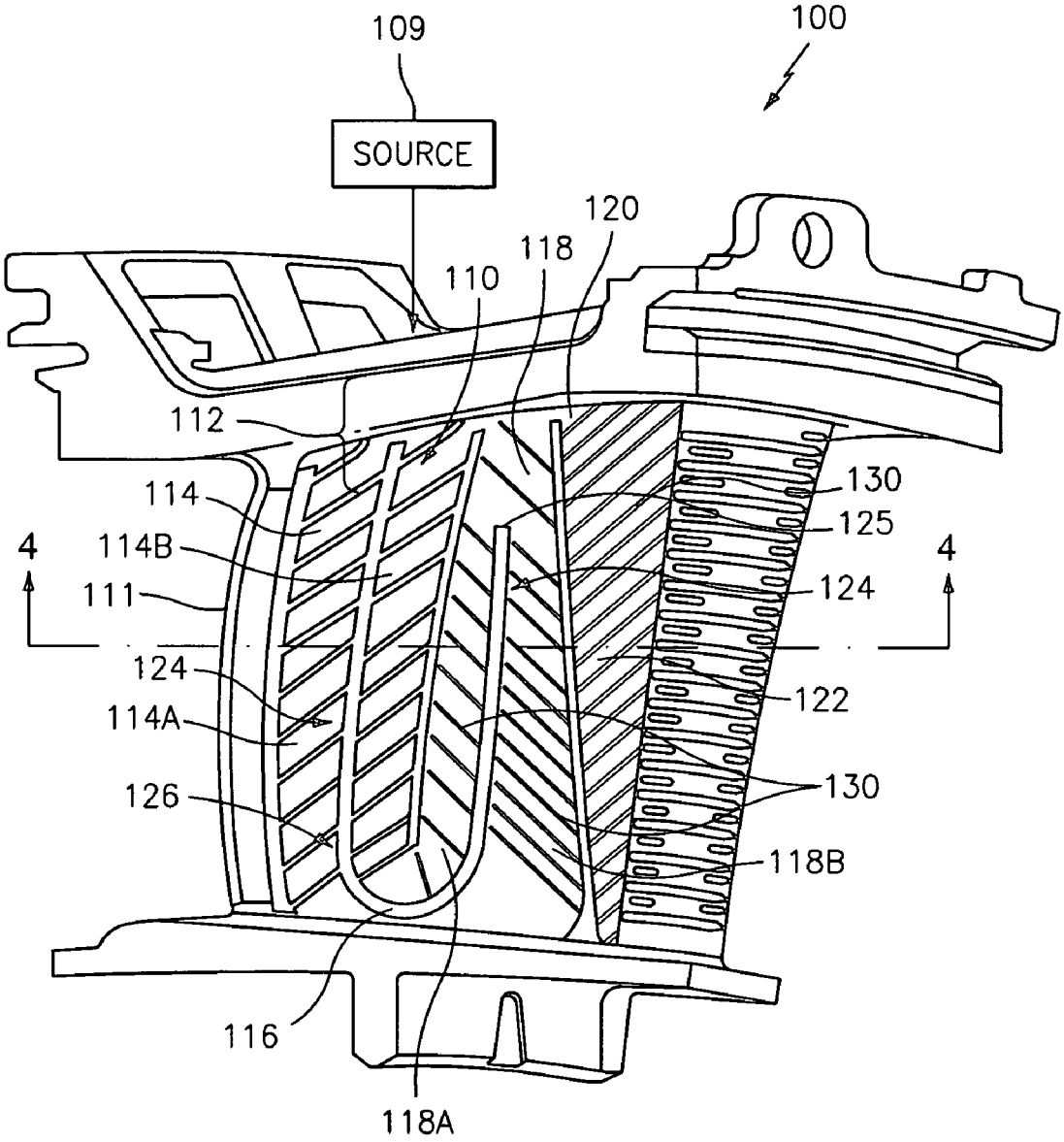
FIG. 3 is a sectional view of a cooling passageway in accordance with the present invention in an airfoil portion of a turbine engine component.
Figure 4:
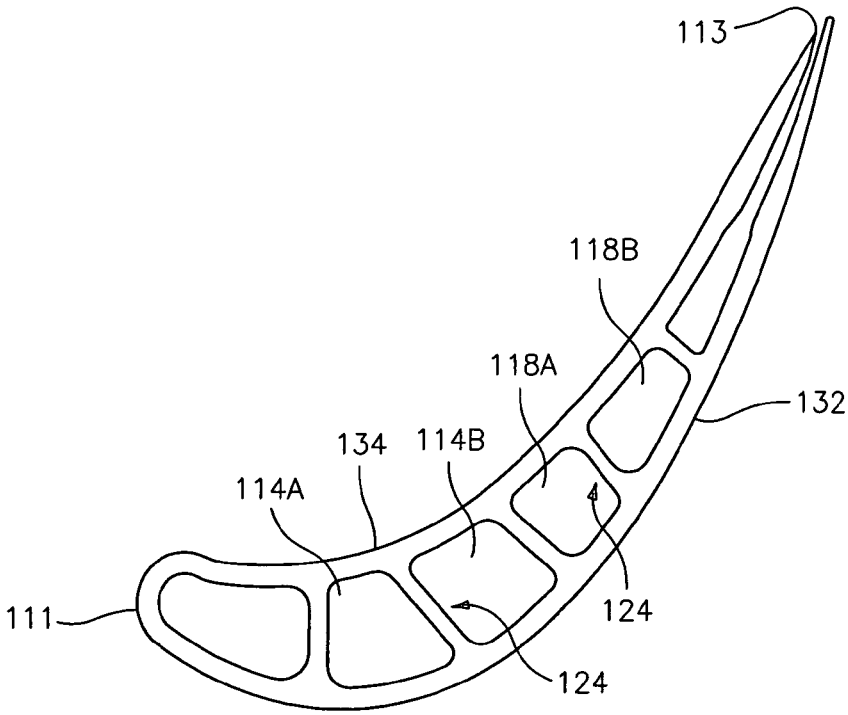
FIG. 4 is a sectional view of the airfoil portion of FIG. 3 taken along lines 4-4 in FIG. 3.

Referring now to FIGS. 3 and 4 of the drawings, there is shown an airfoil portion 111 of a turbine engine component 100 having an enhanced serpentine cooling passageway 110. The passageway 110 has a serpentine configuration with a fluid inlet 112, an inlet channel 114, a first turn 116, an intermediate channel 118, a second turn 120, and an outlet channel 122. The fluid inlet 112 may communicate with a source 109 of cooling fluid. The passageway 110 further has a U-shaped divider rib 124 which may extend from the inlet 112 to divide the channel 114 into a first channel 114A and a second channel 114B.

The U-shaped divider rib 124 allows a split of the cooling fluid entering the passageway 110 into two flow streams to be more easily controlled and to be more uniformly distributed. The U-shaped or arcuately shaped portion 126 of the divider rib 124 assists in guiding the cooling fluid around the first turn 116 in each of the channels 114A and 114B.

As can be seen in FIG. 3, the U-shaped divider rib 124 extends into the intermediate channel 118 and divides at least a portion of the intermediate channel 118 into a first trip strip channel 118A and a second trip strip channel 118B. Each of the channels 118A, 118IB, 114A, and 114B has a plurality of spaced apart, angled trip strips 130 for creating a desirable double vortex flow structure within the cooling fluid flow streams in the channels 118A and 118B which improves heat transfer coefficients. Preferably, the trip strips 130 are staggered one half pitch apart from the suction side wall 132 to the pressure side wall 134. As used herein, the term "pitch" is defined as the radial distance between adjacent trip strips The presence of the U-shaped divider rib 124 in the intermediate channel 118 provides each of the channels 118A and 118B with an improved aspect ratio. As used herein, the term "aspect ratio" means the length of the channel divided by the height. It has been found that as a result of the presence of the U-shaped divider rib 124 in the intermediate channel 118, the aforementioned double vortex flow structure induced by the trip strips 130 begins to develop sooner and generates higher heat transfer coefficients earlier in the passageway 110.

As can be seen in FIG. 3, the U-shaped divider rib 124 has a termination 125 upstream of the second turn 120. The location of the termination 125 is at a point where the flow of the cooling fluid in intermediate channel 118 is fully developed. It has been found that there is minimal cooling flow separation at the downstream termination 125 of the U-shaped divider rib 124. In this location, the two flow streams in channels 118A and 118B are well developed and nearly parallel. Any loss at the junction of the two flow streams in the vicinity of the termination 125 is quite small.

After the two flows are joined in the undivided portion of the channel 118, the joined flow passes around the second turn 120 and into the outlet channel 122. If desired, the outlet channel 122 may also be provided with a plurality of spaced apart, angled trip strips 130. Preferably, the trip strips 130 are staggered one half pitch apart from suction side wall 132 to pressure side wall 134. The cooling flow may exit the outlet channel 122 in any suitable manner known in the art such as through a series of film cooling holes (not shown) or through a plurality of cooling passageways (not shown) in the trailing edge portion 113 of the airfoil 111.

In an alternative embodiment of the present invention, the U-shaped divider rib 124 may be started at a location several hydraulic diameters downstream of the inlet 112 such as 0.5 to 5 hydraulic diameters. As used herein, the term "hydraulic diameter" is approximately 4 times the area of the inlet channel divided by the wetted perimeter of the inlet channel. Placing the beginning of the U-shaped diameter rib 124 in such a location reduces the head loss associated with the split of the incoming cooling fluid flow.

Figure 5:
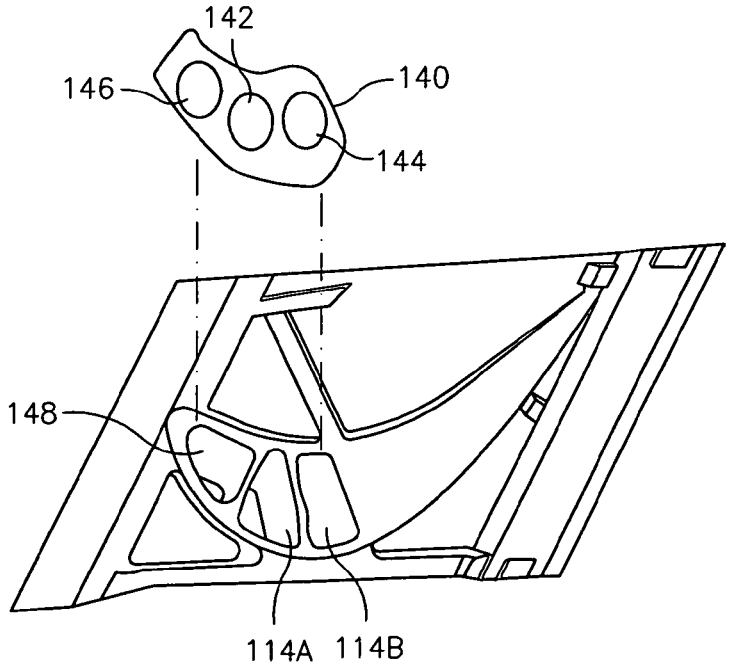
FIG. 5 is a schematic representation of a cover plate having a plurality of metering holes to be placed over the inlet of the cooling passageway of FIG. 3.
Figure 6:
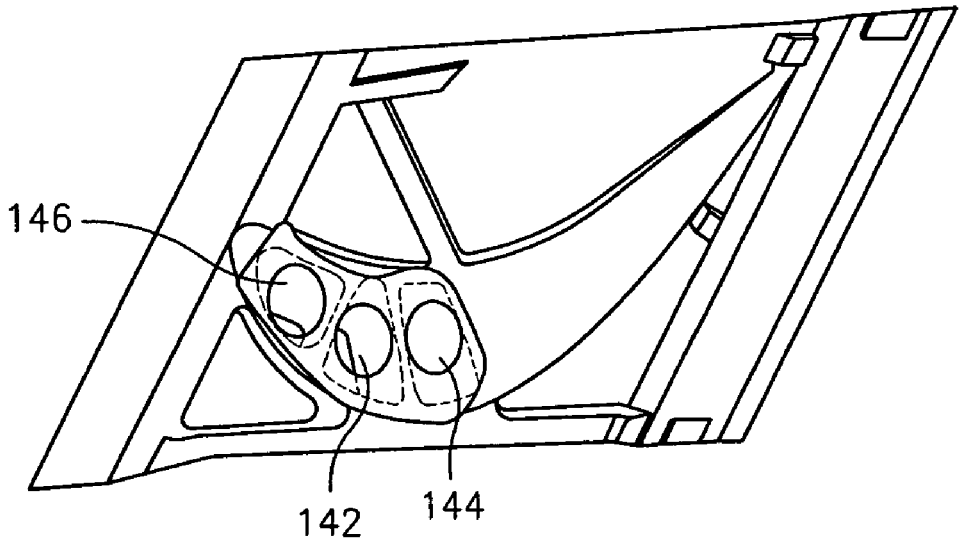
FIG. 6 is a schematic representation of the cover plate of FIG. 5 in position over the inlet of the cooling passageway.

Referring now to FIGS. 5 and 6, if more precise flow tailoring is required, extending the divider rib 124 to the inlet 112 provides a surface onto which a metering plate 140 may be welded or brazed. The metering plate 140 may be provided with at least two flow metering holes 142 and 144 of a desired dimension and configuration that overlap the channels 114A and 114B formed by the divider rib 124. If desired, a third flow-metering hole 146 may be provided in the plate 140. The hole 146 may communicate with the leading edge flow inlet 148.

Turbine engine components, such as blades and vanes, which utilize the enhanced serpentine cooling passageway of the present invention may have both a low cooling air supply pressure and a small cooling flow allocation. The addition of the U-shaped divider rib 124 has several heat transfer benefits and will ensure the success of this configuration without changing the cooling air supply pressure or flow rate. In the present invention, the cavity area is reduced by the size of the divider rib 124, improving the amount of cooling flow per unit area. The aspect ratio of the trip strip channels in the intermediate channels 114 and 118 is dramatically improved, allowing a desirable double vortex structure intended by the angled trip strips 130 to develop quickly. Additionally, the flow around the first turn 116 is completely guided, controlling the loss around the first turn 116, forcing the flow to distribute more evenly around the turn 116, and eliminating flow separation downstream of the turn 116.

A serpentine cooling passageway with a U-shaped divider rib in accordance with the present invention will be superior to a five pass serpentine solution in convective applications where the available cooling supply flow rate and pressure are limited due to the lower level of additional pressure loss. It also allows targeting of internal heat transfer coefficients to a second passage of the inner or outer loop, where a five pass serpentine in satisfying the continual convergence criteria is more limited. The U-shaped rib of the present invention is also preferred to simple divided passages due to both the improved flow structure around the turn and the elimination of the loss associated with dividing a channel in a region with non-negligible Mach number flow, and/or where the flow is not well developed. To achieve full benefit, care must be taken to configure the inner and outer turns properly. The U-shaped divider rib 124 allows tailoring of internal heat transfer coefficients to the inner or outer channel, offering improved design flexibility.

The improvements provided by the cooling passageway of the present invention will lead to greatly increased airfoil oxidation and thermal mechanical fatigue (TMF) cracking life in the mid-body of the airfoil portion of the turbine engine component.

It is apparent that there has been provided in accordance with the present invention an enhanced serpentine cooling with a U-shaped divider rib which fully satisfies the objects, means, and advantages set forth hereinbefore. While the present invention has been described in the context of specific embodiments thereof, other unforeseeable alternatives, modifications, and variations may become apparent to those skilled in the art having read the foregoing description. Accordingly, it is intended to embrace any unforeseeable alternatives, modifications, and variations that fall within the broad scope of the appended claims.

What is claimed is:

1. A cooling passageway for use in an airfoil portion of a turbine engine component having a pressure side wall and a suction side wall, said cooling passageway comprising:

a serpentine flow passageway through which a cooling fluid flows, said passageway having an inlet through which cooling fluid is introduced into said passageway;

said passageway having an inlet channel, an intermediate channel, and an outlet channel;

said passageway having a first turn between said inlet channel and said intermediate channel; and a divider rib extending from a location in said inlet channel to a termination in said intermediate channel to divide a portion of inlet channel into a first inlet channel and a second inlet channel and a portion of said intermediate channel into a first intermediate channel and a second intermediate channel, said divider rib having an arcuately shaped portion located in said first turn to promote flow of said cooling fluid around said first turn, and said divider rib being solid from said location in said inlet channel to said termination in said intermediate channel including said arcuately shaped portion.

2. The cooling passageway of claim 1, wherein said divider rib has a U-shape.

3. The cooling passageway of claim 1, wherein said divider rib adjacent said inlet.

4. The cooling passageway of claim 1, wherein said divider rib begins several hydraulic diameters downstream of the inlet.

5. The cooling passageway of claim 1, wherein each of said first and second intermediate channels has a plurality of trip strips.

6. The cooling passageway of claim 5, wherein adjacent ones of said trip strips in said intermediate channels are staggered by one half pitch apart from said suction side wall to said pressure side wall.

7. The cooling passageway of claim 1, wherein said passageway has a second turn between said intermediate channel and said outlet channel.

8. A cooling passageway for use in an airfoil portion of a turbine engine component having a pressure side wall and a suction side wall, said cooling passageway comprising:

a serpentine flow passageway through which a cooling fluid flows, said passageway having an inlet through which cooling fluid is introduced into said passageway;

said passageway having an inlet channel, an intermediate channel, and an outlet channel;

a divider rib extending from a location in said inlet channel to a termination in said intermediate channel; and a metering plate attached to said divider rib.

9. The cooling passageway of claim 8, wherein said divider rib divides said inlet channel into a first channel and a second channel and said metering plate has two holes for metering flow of said cooling fluid into said first and second channels.

10. The cooling passageway of claim 9, wherein said termination is located upstream of a turn in said passageway from said intermediate channel to said outlet channel and is located at a point where the flow of cooling fluid in said intermediate channel is fully developed.

11. A turbine engine component comprising:

an airfoil portion having a suction side wall and a pressure side wall;

a serpentine cooling passageway within said airfoil portion located between said suction side wall and said pressure side wall;

said serpentine cooling passageway having an inlet channel, an intermediate channel, a first turn fluid connecting said inlet channel to said intermediate channel, an outlet channel, and a second turn fluidly connecting said intermediate channel to said outlet channel;

said inlet channel communicating with a source of cooling fluid via a fluid inlet;

means for dividing said flow within said inlet channel and a portion of said intermediate channel into two flow streams; and said dividing means having a solid portion for guiding each of said flow steams from said inlet channel through said first turn to said intermediate channel.

12. The turbine engine component according to claim 11, wherein said dividing means has a beginning point adjacent said inlet.

13. The turbine engine component according to claim 11, wherein said dividing means has a beginning point located several hydraulic diameters from said inlet for reducing head loss.

14. The turbine engine component according to claim 11, wherein said dividing means has a termination upstream of said second turn.

15. The turbine engine component according to claim 14, wherein said termination is located at a point where flow in said intermediate channel is fully developed.

16. The turbine engine component according to claim 11, wherein said dividing means comprises a U-shaped rib.

17. The turbine engine component according to claim 11, wherein said intermediate channel has means for creating a double vortex flow.

18. The turbine engine component according to claim 17, wherein said double vortex flow creating means comprises a plurality of trip strips within said intermediate channel.

19. The turbine engine component according to claim 18, further comprising adjacent ones of said trip strips being staggered one half pitch apart from the suction side wall to the pressure side wall.

* * * * *